US006856780B2

(12) United States Patent
Kadota et al.

(10) Patent No.: US 6,856,780 B2
(45) Date of Patent: Feb. 15, 2005

(54) METHOD AND DEVICE FOR DEVELOPING A LATENT IMAGE AND IMAGE FORMING APPARATUS USING THE SAME

(75) Inventors: Ichiro Kadota, Tokyo (JP); Takashi Hodoshima, Kanagawa (JP); Nobutaka Takeuchi, Kanagawa (JP); Teiichiro Takano, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 21 days.

(21) Appl. No.: 10/638,432

(22) Filed: Aug. 12, 2003

(65) Prior Publication Data

US 2004/0096244 A1 May 20, 2004

(30) Foreign Application Priority Data

Aug. 13, 2002 (JP) ..... 2002-235461

(51) Int. Cl.[7] ..... G03G 15/09
(52) U.S. Cl. ..... 399/267; 399/270
(58) Field of Search ..... 399/252, 265, 399/266, 267, 270; 430/122

(56) References Cited

U.S. PATENT DOCUMENTS 4,576,463 A * 3/1986 Sakamoto et al. ..... 399/267
4,987,853 A * 1/1991 Allen et al. ..... 399/256
5,173,388 A * 12/1992 Uezono et al. ..... 430/122

* cited by examiner

*Primary Examiner*—Hoan Tran
(74) *Attorney, Agent, or Firm*—Oblon, Spivak, McClelland, Maier & Neustadt, P.C.

(57) ABSTRACT

A developing method of the present invention uses a sleeve accommodating a stationary magnet roller formed with a plurality of magnetic poles and facing an image carrier. The sleeve is rotated to convey a developer, which is made up of toner grains and magnetic carrier grains and deposited on the sleeve, to a developing zone for thereby feeding the toner grains from a magnet brush formed by the developer to a latent image formed on the image carrier. When the developing zone is seen from the image carrier side, the ratio of the total area of voids present at the tips of the magnet brush to the total area of the developing zone is selected to be 25% or less.

66 Claims, 7 Drawing Sheets

FIG. 7

| | (TOTAL VOID ARE)/(TOTAL ZONE AREA) | MEAN VOID SIZE IN AXIAL DIRECTION (μm) | MEAN VOID SIZE IN DIRECTION OF ROTATION (μm) | ROUGHNESS |
|---|---|---|---|---|
| EX. 1 | 11 | 46 | 141 | ○ |
| EX. 2 | 9 | 25 | 122 | ○ |
| COM. EX 1 | 30 | 90 | 262 | × |
| COM. EX 2 | 35 | 110 | 279 | × |

FIG. 8

| | (CENTER TOTAL VOID AREA)/(TOTAL CENTER AREA) | ESTIMATION BASED ON SIZE | ROUGHNESS |
|---|---|---|---|
| EX. 3 | 5 | ○ | ○ |
| EX. 4 | 14 | ○ | ○ |
| EX. 5 | 10 | ○ | ○ |
| EX. 6 | 7 | ○ | ○ |
| EX. 7 | 10 | ○ | ○ |
| EX. 8 | 8 | ○ | ○ |
| EX. 9 | 13 | ○ | ○ |
| EX. 10 | 8 | ○ | ○ |
| EX. 11 | 9 | ○ | ○ |
| EX. 12 | 3 | ○ | ○ |
| EX. 13 | 7 | ○ | ○ |
| COM. EX. 3 | 22 | × | × |
| COM. EX. 4 | 23 | × | × |
| COM. EX. 5 | 24 | × | × |
| COM. EX. 6 | 29 | × | × |

FIG. 9

| | ROUGHNESS | VOID STATE FUNCTION | RATIO OF DOWNSTREAM VOIDS OF LESS THAN 17,500 μm² | RATIO OF CENTER VOIDS OF LESS THAN 17,500 μm² | RATIO OF UPSTREAM VOID OF LESS THAN 17,500 μm² | DOWNSTREAM MEAN VOID AREA | CENTER MEAN VOID AREA | UPSTREAM MEAN VOID AREA | CENTER S1/S2 (%) | (TOTAL DOWNSTREAM VOID AREA)/(TOTAL DOWNSTREAM AREA) | (TOTAL CENTER VOID AREA)/(TOTAL CENTER AREA) | (TOTAL UPSTREAM VOID AREA)/(TOTAL UPSTREAM AREA) |
|---|---|---|---|---|---|---|---|---|---|---|---|---|
| EX. 14 | ○ | 4.7 | 22 | 29 | 88.6 | 3566 | 3566 | 6274 | 40.5 | 27 | 22 | 29 |
| EX. 15 | ○ | 1.8 | 5 | 24 | 88.8 | 3720 | 3720 | 6144 | 51.4 | 23 | 5 | 24 |
| EX. 16 | ○ | 1.8 | 14 | 21 | 94.2 | 3261 | 3261 | 7286 | 46.2 | 18 | 14 | 21 |
| EX. 17 | ○ | 2.0 | 10 | 21 | 89.5 | 3370 | 3370 | 5042 | 47.4 | 23 | 10 | 21 |
| EX. 18 | ○ | 0.7 | 7 | 14 | 92.4 | 2701 | 2701 | 5367 | 49.4 | 9 | 7 | 14 |
| EX. 19 | ○ | 2.1 | 10 | 24 | 92.1 | 3332 | 3332 | 4056 | 44.7 | 22 | 10 | 24 |
| EX. 20 | ○ | 2.0 | 8 | 20 | 94.0 | 4944 | 4944 | 7410 | 60.3 | 25 | 8 | 20 |
| EX. 21 | ○ | 1.8 | 13 | 21 | 91.8 | 2933 | 2933 | 5468 | 49.6 | 22 | 13 | 21 |
| EX. 22 | ○ | 1.8 | 8 | 32 | 94.3 | 4151 | 4151 | 4836 | 51.0 | 28 | 8 | 32 |
| EX. 23 | ○ | 1.6 | 9 | 25 | 89.5 | 3571 | 3571 | 6788 | 50.1 | 19 | 9 | 25 |
| EX. 24 | ○ | 0.3 | 3 | 9 | 96.2 | 3100 | 3100 | 3221 | 53.5 | 12 | 3 | 9 |
| EX. 25 | ○ | 0.3 | 7 | 13 | 92.4 | 4439 | 4439 | 6454 | 53.5 | 9 | 7 | 13 |
| CMP. EX. 7 | × | 11.9 | 14 | 39 | 65.8 | 5360 | 5360 | 10846 | 39.4 | 38 | 14 | 39 |
| CMP. EX. 8 | × | 6.1 | 22 | 22 | 84.7 | 5629 | 5629 | 8512 | 39.6 | 29 | 22 | 22 |
| CMP. EX. 9 | × | 6.6 | 23 | 30 | 80.8 | 6480 | 6480 | 15436 | 39.2 | 23 | 23 | 30 |
| CMP. EX. 10 | × | 6.1 | 24 | 33 | 89.2 | 6872 | 6872 | 8953 | 35.7 | 32 | 24 | 33 |
| CMP. EX. 11 | × | 12.1 | 29 | 30 | 72.7 | 6018 | 11549 | 11549 | 38.3 | 37 | 29 | 30 |

METHOD AND DEVICE FOR DEVELOPING A LATENT IMAGE AND IMAGE FORMING APPARATUS USING THE SAME

BACKGROUND OF THE INVENTION

1. Field of the Invention

The present invention relates to a method and a device for developing a latent image formed on an image carrier and an image forming apparatus using the same.

2. Description of the Background Art

An image forming apparatus of the type developing a latent image formed on an image carrier with a developer made up of toner grains and magnetic carrier grains is conventional and implemented as a copier, a printer or a facsimile apparatus by way of example, Generally, a developing device included in this type of image forming apparatus uses a rotatable sleeve, which accommodates stationary magnetic field forming means therein, as a developer carrier. The sleeve in rotation conveys the developer deposited thereon to a developing zone. In the developing zone, the developer forms a magnet brush around a position where the sleeve and image carrier are closest to each other, and contacts the image carrier. In the developing zone, the toner grains are caused to deposit on a latent image formed on the image carrier by an electric field, which is formed by the surface potential of the image carrier and a bias applied to the sleeve.

Various improvements relating to the developing device have heretofore been proposed to protect images from roughness or graininess. For example, the electric field between the image carrier and the sleeve may be implemented as an alternating electric field for effecting development while promoting the rearrangement of the toner grains. However, the maximum value of an alternating electric field is greater that the maximum value of a DC electric field, so that the carrier grains are apt to deposit on the image carrier. Also, an alternating electric field cannot be formed without resorting to an exclusive power supply, which increases cost. It is therefore desirable to obviate roughness while using a DC electric field.

Low density of the magnetic brush in the developing region is one of major causes of roughness and obstructs uniform development. In light of this, Japanese Patent Laid-Open Publication No. 8-146668, for example, proposes to determine the density of the magnet brush in the developing zone by using the volume ratio of carrier grains present in the developing zone.

We, however, experimentally found that graininess of an image was not constant for the same volume ratio of carrier grains. This means that even the volume ratio of carrier grains cannot account for the relation between the density of the magnet brush in the developing zone and graininess. In the case where a DC electric field is formed between the image carrier and the sleeve, toner grains fly from the tips of the magnet brush toward the image carrier, but fly from the roots of the magnet brush little. Stated another way, mainly the tips of the magnet brush contribute to development. It follows that consideration must be given to at least the arrangement and density of the magnet brush.

SUMMARY OF THE INVENTION

It is an object of the present invention to provide a developing method and a developing device capable of insuring high-quality images free from roughness by using characteristic values representative of the condition of the tips of a magnet brush, and an image forming apparatus using the same.

BRIEF DESCRIPTION OF THE DRAWINGS

The above and other objects, features and advantages of the present invention will become more apparent from the following detailed description taken with the accompanying drawings in which:

FIGS. 7 through 9 show tables listing the results of experiments conducted with various examples of the illustrative embodiment and comparative examples to determine graininess.

DESCRIPTION OF THE PREFERRED EMBODIMENT

Figure 1:
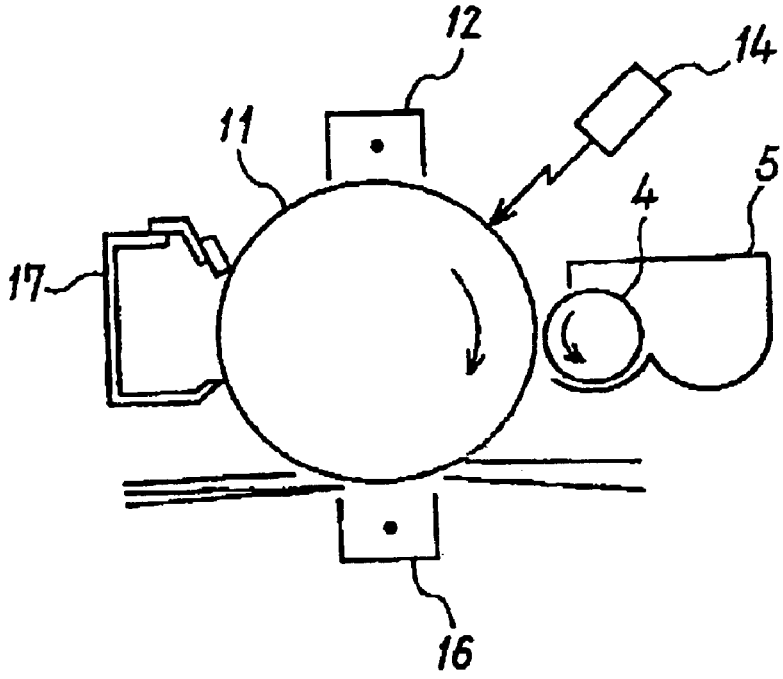
FIG. 1 shows an image forming apparatus embodying the present invention.

Referring to FIG. 1 of the drawings, an image forming apparatus embodying the present invention is shown. As shown, the image forming apparatus includes a photoconductive drum or image carrier 11. Arranged around the drum 11 are a charger 12, an exposing unit 14, a developing unit 15, an image transferring unit 16, a cleaning unit 17 and a quenching lamp or discharger not shown. The image forming apparatus additionally includes a sheet conveying device and a fixing unit although not shown specifically. The sheet conveying device conveys a sheet or recording medium paid out from a sheet tray to a position where the drum 11 and image transferring unit 16 face each other. The fixing unit fixes a toner image transferred from the drum 11 to the sheet.

In operation, while the drum 6 is caused to rotate at constant speed in a direction indicated by an arrow in FIG. 1, the charger 12 uniformly charges the surface of the drum 11. The exposing unit 14 scans the charged surface of the drum 11 with a light beam in accordance with image data to thereby form a latent image. In the illustrative embodiment, assume that the scanned portion and non-scanned portion of the drum 11 form an image portion and a background portion, respectively. The developing unit 15 develops the latent image with a developer deposited on a sleeve 4, which is applied with a bias for development from a power supply not shown, thereby producing a corresponding toner image. The image transferring unit 16 transfers the toner image from the drum 11 to a sheet fed from the sheet cassette. Subsequently, the fixing unit fixes the toner image on the sheet.

After the image transfer from the drum 11 to the sheet, the cleaning unit 17 removes toner left on the drum 11 for thereby collecting it. Subsequently, the quenching lamp discharges the surface of the drum 11.

While in the illustrative embodiment the toner image is transferred to a sheet, it may, of course, be transferred to an intermediate image transfer body or similar image carrier known in the art.

Figure 2:
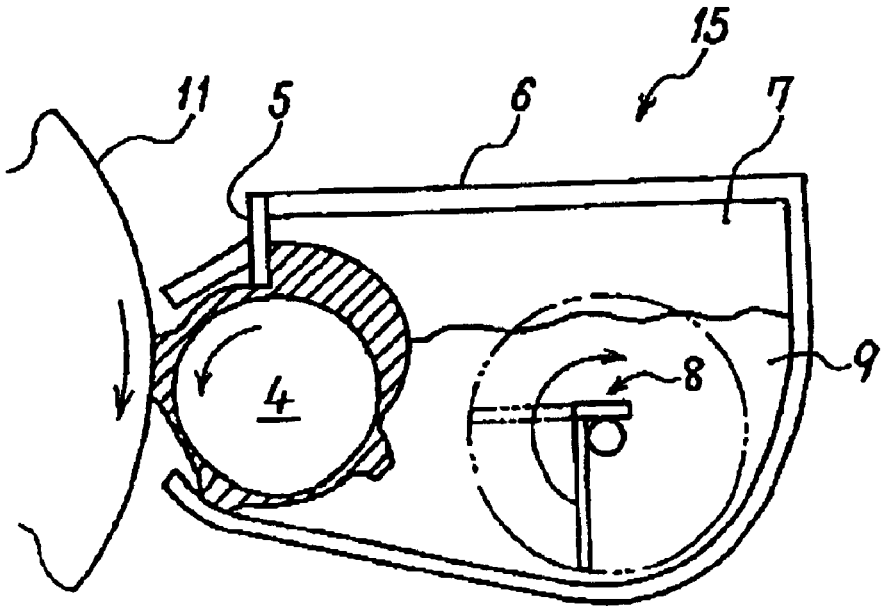
FIG. 2 is a section showing a developing unit included in the illustrative embodiment.

FIG. 2 shows the developing unit 15 in detail. As shown, the developing unit 15 includes a case 6 formed with an opening facing the drum 11. A developing roller or developer carrier is partly exposed to the outside of the developing unit 15 via the opening of the case 6. A two-ingredient developer, made up of toner grains and magnetic carrier grains, is deposited on the developing roller. More specifically, the developing roller is made up of the previously mentioned sleeve 4 formed of a nonmagnetic material and a stationary magnet roller or magnetic field forming means disposed in the sleeve 4. The sleeve 4 is rotatable around the magnet roller.

A doctor blade or metering member 5 regulates the amount of the developer being conveyed by the sleeve 4. A paddle 8 is positioned in parallel to the sleeve 4. The stationary magnet roller has a main pole P1 facing the drum 11 and has S and N poles alternating with each other in the counterclockwise direction, although not shown specifically. The magnet roller additionally has a pole of the same polarity as the developer at a position downstream of the position where the sleeve 4 faces the drum 11, so that the developer is peeled off from the sleeve 4.

In the illustrative embodiment, the sleeve 4 is formed of aluminum and has its surface roughened by sand blasting.

In the developing device 15, the developer is agitated and charged by friction thereby with the result that toner grains of negative polarity deposit on carrier grains of positive polarity. The paddle 8, rotated by a motor in a direction indicated by an arrow in FIG. 2, conveys the developer present in the case 6 toward the developing sleeve 4. At this instant, the developer deposits on the sleeve 4 by being magnetically attracted by the magnet roller, forming a magnet brush on the sleeve 4. The sleeve 4 in rotation conveys the developer thus deposited thereon to a position where the sleeve 4 is closest to the drum 11, while the doctor blade 5 causes the developer to form a thin layer on the sleeve 4. As a result, the toner grains contained in the developer are transferred from the sleeve 4 to the latent image formed on the drum 11, developing the latent image.

In the illustrative embodiment, the sleeve 4 and drum 11 are provided with diameters of 30 mm and 90 mm, respectively. The potential of the background portion or non-image portion and the potential of the image portion of the drum 11 are selected to be −640 V and −130 V, respectively, while the bias Vb for development is selected to be DC −470 V. The other conditions for development are selected as shown below:

gap for development: 0.25 mm or 0.40 mm
amount of deposition: 38 mg/cm$^2$ to 80 mg/cm$^2$
main pole angle: 0° to 4°
drum linear velocity; 1.5 to 2.4
carrier grain size: 35 $\mu$m to 55 $\mu$m
toner grain size: 6.8 $\mu$m
toner content: 5 wt % to 9 wt %
(adjusted to uniform coating ratio)
charge: −20 $\mu$C/g There are prepared three different types of magnet rollers, i.e., Type 1 whose main pole half-value width and peak flux density are 27° and 92 mT, respectively, Type 2 whose main pole half-value width and peak flux density are 14° and 85 mT, respectively, and Type 3 whose main pole half-value width and peak flux density are 14° and 69 mT, respectively.

Images were formed under the above conditions in order to estimate roughness of images, which is represented by graininess. To measure graininess, an image present in a halftone portion is read by a scanner, and then about 1 cm$^2$ patches are prepared. A power spectrum, produced by effecting Fourier transform with the above image, is covered with a frequency filter representative of human visual sensation, so that part of the power spectrum conspicuous to human eyesight is separated and then integrated. The resulting numerical value of each patch will be referred to as graininess. Particularly, the illustrative embodiment uses the mean value of portions where lightness is between 40 and 80. The smaller the graininess, the less the roughness.

Figure 3:
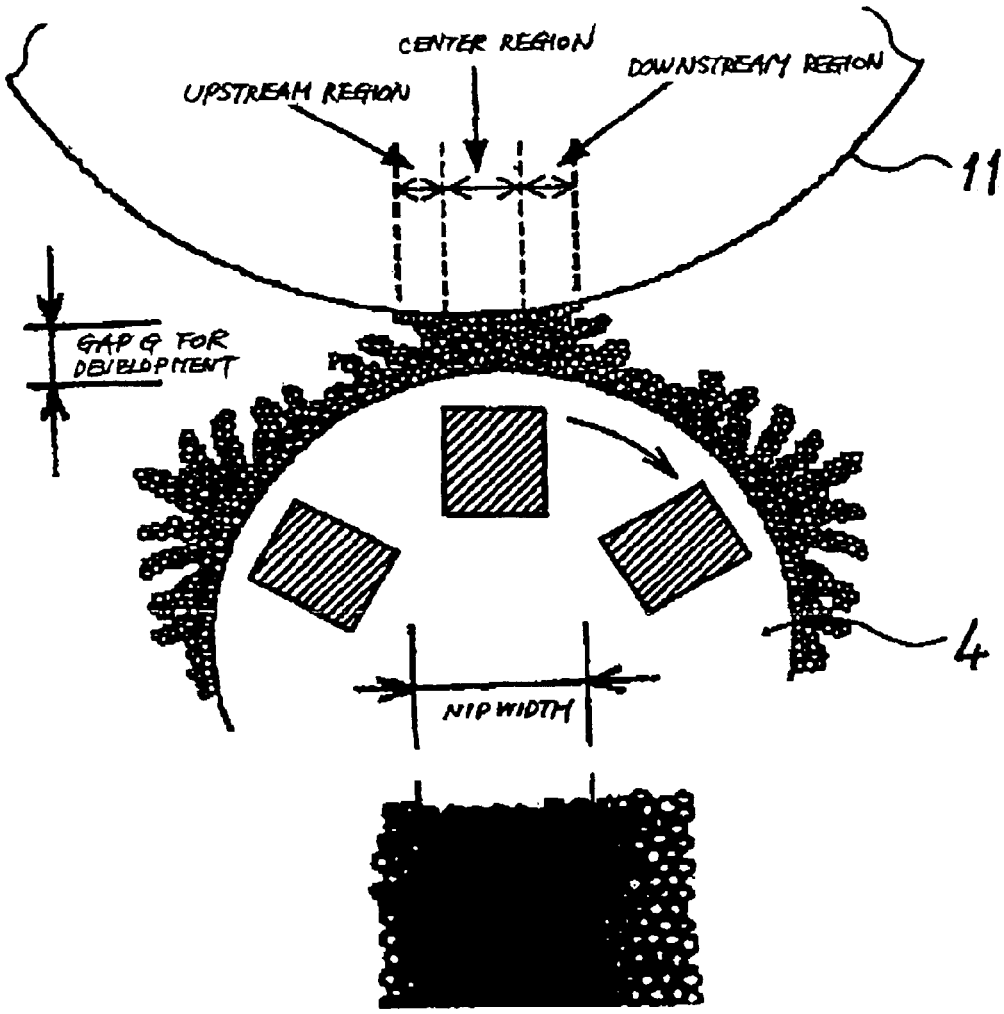
FIG. 3 is a fragmentary view for describing the condition of a magnet brush in a developing zone.

Hereinafter will be described a method of measuring voids present at the tips of the magnet brush or brush chains constituting it, as seen from the drum 11 side, in a developing zone. As shown in FIG. 3, the developing zone refers to a zone where the magnet brush on the sleeve 4 and drum 11 contact each other. In the illustrative embodiment, the developing zone is subdivided into three regions in the direction of rotation of the sleeve 4, i.e., an upstream region, a center region and a downstream region, In the upstream region, the magnet brush rises on the sleeve 4 in the form of brush chains and starts contacting the drum 11 while, in the center region, the magnet brush stands substantially vertically toward the drum 11. In the downstream region, the magnet brush starts falling down and leaving the drum 11.

To determine voids at the tips of the magnet brush, as seen from the drum 11 side, use is made of a visualizing device for observing the magnet brush in the developing zone. The visualizing device includes a transparent acrylic tube with a diameter of 90 mm in place of the drum 11. The sleeve 4 is spaced from the acrylic tube by a preselected distance. Part of the acrylic tube not contacting the sleeve 4 is removed so as to observe the tips of the magnet brush in the developing zone via the inside of the tube. Further, a transparent conductive sheet is adhered to the surface of the acrylic tube while a potential difference is established between the tube and the sleeve 4. In this condition, it is possible to clearly see the tips of the magnet brush while preventing the toner grains from depositing on the acrylic tube.

Figure 4:
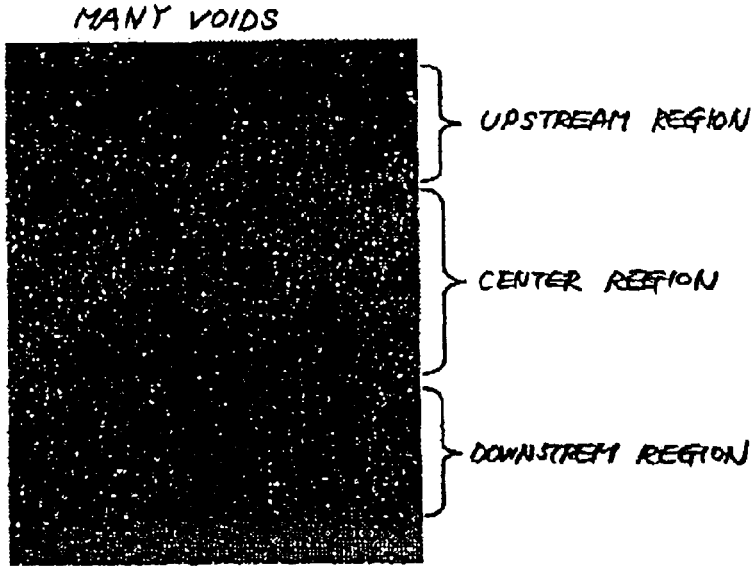
FIG. 4 is a photograph of a magnet brush including many voids, as seen from the photoconductive drum side.
Figure 5:
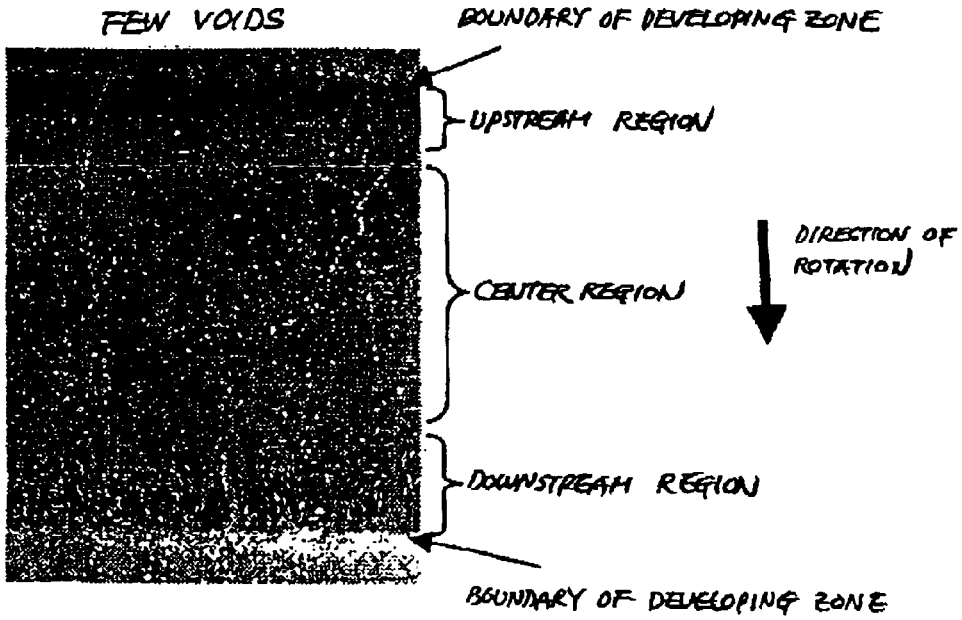
FIG. 5 is a photograph of a magnet brush including few voids, as seen from the photoconductive drum side.

The tips of the magnet brush, being observed via the above visualizing device, are picked up by a CCD (Charge Coupled Device) camera such that the tips can be observed over at least 5.4 mm in the lengthwise direction by the depth of about a single carrier layer. FIGS. 4 and 5 respectively show a photograph of a magnet brush in which numerous voids were present and a photograph of a magnet in which few voids were present. Such photographs each are subject to bilevel processing using Image. Hyper 2 or similar image processing software and a suitable threshold value to thereby divide it into magnet brush portions and void portions where carrier grains are absent. Further, the area of the individual void, the mean area of the individual voids, the number of voids and other statistical information are obtained region by region.

In Examples 1 and 2 and Comparative Examples 1 and 2, roughness was estimated in terms of graininess by varying the ratio of the total area of voids, as measured at the tips of the magnet brush in the developing zone, to the total area of the developing zone. Also, there was studied a relation between roughness and the size of the individual void in the axial direction and the direction of rotation of the sleeve 4. While the total area of the voids should, of course, be reduced to protect an image from conspicuous roughness, it is important, in practice, to prevent the individual voids from extending in the direction of rotation of the sleeve 4. FIG. 7 lists the results of Examples 1 and 2 and Comparative Examples 1 and 2. In FIG. 7, a circle is representative of graininess of less than 0.46 while a cross is representative of graininess of 0.46 or above.

As FIG. 7 indicates, a close correlation exists between roughness and the ratio of the total area of voids to the total area of the developing zone. More specifically, it was experimentally found that when the above ratio was 25% or below, images free from roughness were achievable. Ratios above 25% rendered irregular contact and therefore roughness conspicuous. It was also found that images free from roughness were achievable if the size of the individual void, a seen in the developing zone, was 70 μm or below on the average in the axial direction of the sleeve 4 and 200 μm or below on the average in the direction of rotation of the sleeve 4.

When actual development is observed in more detail, toner effectively deposits on a latent image in the region where the electric field for development is strongest, i.e., at the center region of the developing zone. That is, toner is transferred to a latent image mainly from part of the magnet brush contacting the drum 11 at the center region of the developing zone. In light of this, paying attention to voids at the tips of the magnet brush in the center region of the developing zone, Examples 3 through 13 and Comparative Examples 3 through 6 to be described hereinafter estimated roughness in terms of graininess by varying the ratio of the total area of voids at the center region to the total area of the center region.

Also, a relation between the size of the individual void in the two directions mentioned earlier in the center region of the developing zone and roughness was studied. FIG. 8 lists the results of Examples 3 through 13 and Comparative Examples 3 through 6. In FIG. 8, a circle indicates a mean void size of 70 μm or below in the axial direction of the sleeve 4 and 200 μm or below in the direction of rotation of the sleeve 4 while a cross indicates a mean void size larger than 200 μm in the direction of rotation of the sleeve 4.

As FIG. 8 indicates, a close correlation exists between roughness and the ratio of the total area of voids in the center region of the developing zone to the total area of the center region, as seen from the drum 11 side, and the size of the individual void. More specifically, it was found that when the above ratio was 20% or below, images free from roughness were achieved. Ratios above 20% rendered irregular contact and therefore roughness conspicuous. It was also found that when the mean size of the individual voids was 70 μm or below in the axial direction of the sleeve 4 and 200 μm or below in the direction of rotation of the sleeve 4, images free from roughness were attained.

As for the arrangement of the magnet brush in the developing zone, as shown in FIGS. 4 and 5, the magnet brush is sparser and includes more voids in the upstream region than in the center region. In the center region, the magnet brush is dense and includes few voids because the distance between the drum 11 and sleeve 4 is smallest and because magnetic lines of force extend substantially from the axis of the sleeve 4 toward the axis of the drum 11. In the downstream region, the magnet brush again becomes sparse and includes many voids. Presumably, the upstream and center regions allow toner to deposit on a latent image as expected, but the downstream region where the electric field is weak causes scavenging and toner sweeping to easily occur and has therefore adverse influence on an image.

Therefore, to realize uniform development in the upstream and center regions, it is necessary to make the magnet brush in such regions dense and cause it to uniformly contact the drum 11. Also, to prevent a toner image developed up to the center region from being irregularly disturbed by the magnet brush, it is necessary to cause the magnet brush to uniformly fall down and leave the drum 11 in the downstream region. The magnet brush uniformly falls down only if a clear boundary where the magnet brush leaves the drum 11 exists. In this condition, the magnet brush becomes dense in the downstream region.

Figure 6:
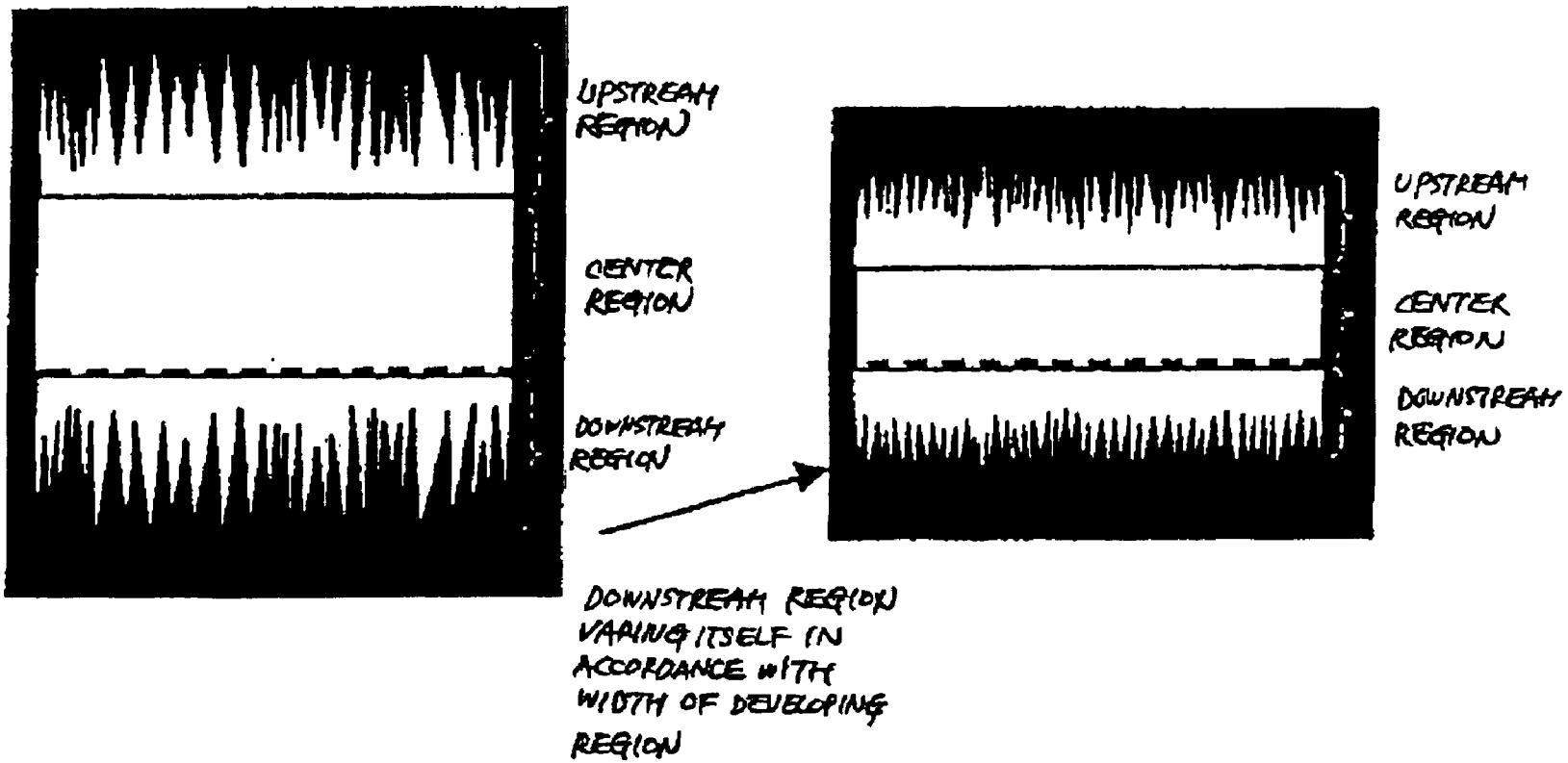
FIG. 6 shows the developing zone.

It follows from the above that to realize an image free from roughness, it is important to reduce the ratio of the total area of voids in the upstream and center regions of the developing zone to the total area of each region and to reduce the ratio of the total area of voids in the downstream region to the total area of the downstream region, see FIG. 6.

In Examples 14 through 25 and Comparative Examples 11 to be described hereinafter, roughness of an image was estimated in terms of graininess by varying the total area of voids in each of the upstream, center and downstream regions and the total area of each region. Also, there was studied a relation between roughness and the mean area of the individual voids in each of the upstream, center and downstream regions. By reducing the area of the individual void of the magnet brush contacting the drum 11, it is possible to maintain the density of the magnet brush, constituting to development, high and uniform.

Assume that the total area of, among voids present in the center region, voids smaller than a mean void size is S1 , and that the total void area in the center region is S2. Then, a ratio S1/S2 was determined to see a relation between the ratio S1/S2 and roughness. The smaller the ratio S1/S2, the larger the number of large voids in the center region and therefore the more irregular the tips of the magnet brush. Stated another way, the larger the ratio S1/S2, the smaller the size of the individual void and the more uniform the magnet brush distribution in the center region.

Further, there was studied a relation between roughness and a void state function expressed as:

$$\alpha 1 \cdot p1 \cdot q1 + \alpha 2 \cdot p2 \cdot q2 + \alpha 3 \cdot p3 \cdot q3$$

where coefficients $\alpha 1$, $\alpha 2$ and $\alpha 3$ denote numerical values found to have the closest correlation then 0 to 1 were substituted for, and are representative of an approximate equation derived from the results of experiments listed FIG. 9. FIG. 9 shows Examples 14 through 25 and Comparative Examples 7 through 11 In FIG. 9, a circle indicates S1/S2 of 0.4 or above while a cross indicates S1/S2 of less than 0.4. As for the void state function, a circle indicates 0 or above, but less than 5, while a cross indicates 5 or above.

As FIG. 9 indicates, a close correlation exists between roughness and the mean area of the individual voids in each of the upstream center and downstream regions, as seen from the drum 11 side, the ratio S1/S2 and the void state function. More specifically, it was experimentally found that when the ratio S1/S2 was greater than 0.4, an image free from roughness was achieved. When the ratio S1/S2, showing the distribution of the individual voids, was 0.4 or above, irregular contact was conspicuous while a sufficient number of times of contact was not attained, resulting in roughness.

Experiments showed that an image free from roughness was attained when the mean area of the individual voids is 7,500 $m^2$ or less in the upstream region, 5,000 $m^2$ or less in the center region and 7,500 $m^2$ or less in the downstream region. Also, when the void state function was larger than 0, but smaller than 5, images were free from roughness. In this manner, it is possible to achieve high image quality when attention is paid not only to the sparseness of the magnet brush in the center region, but also to sparseness in the downstream portion where the brush falls down away from the drum 11.

Further, roughness can be obviated if various conditions including the configuration of the magnet roller, which forms the magnet brush, the amount of deposition of the developer, the bias for development and a linear velocity ratio are adequately selected, as will be described hereinafter. As for the magnet roller, when the flux density of the main pole, facing the developing zone, in the normal direction is between 60 mT and 120 mT, images free from roughness can be implemented despite the use of a DC bias for development. If the flux density in the above direction is higher than 120 mT, then the magnet brush in the developing zone is sparse and aggravates roughness. If the flux density is lower than 60 mT, then magnetic restraint acting on carrier grains is reduced, resulting in carrier deposition.

As for the bias applied to the sleeve 4, when use is made of an oscillating bias that forms an alternating electric field between the sleeve 4 and the drum 1, the roughness of an image can be further reduced. This is because the alternating electric field causes the toner grains deposited on the drum 11 to repeatedly deposit on and leave the drum 11, thereby implementing a uniform distributions When the DC bias was replaced with an oscillating bias having a DC component VCD of −420 V and an amplitude Vpp of 900 V, images free from roughness were achieved under the conditions of FIGS. 7 and 8 if the ratio of the total area of voids to the total area of the developing zone and void state function were small. The above oscillating bias reduced roughness more than the DC bias.

Experiments were conducted by applying the DC bias to the sleeve 4 under the conditions of FIGS. 7 and 8, but lowering the charge potential of the drum 11 and development potential to −450 V and 250 V, respectively. The resulting images were comparable in roughness with images formed by the usual potentials if the ratio of the total area of voids to the total area of the developing zone and void state function were small.

The amount of the developer to deposit on the sleeve 4 is selected to fall between 20 mg/cm$^2$ and 200 mg/cm$^2$. When the amount of deposition is as large as 20 mg/cm$^2$ or above, the developer is uniformly packed in the developing zone with the result that the ratio of the total area of voids to the total area of developing zone is reduced, successfully reducing roughness. If the amount of deposition is larger than 100 mg/cm$^2$, then the developer gathers at the upstream side of the developing zone and causes the magnet brush to contact the drum 11 even in the region where the electric field is weak, not only aggravating roughness but also causing the edges of images to be lost.

It was experimentally found that the ratio of the linear velocity of the sleeve 4 to that of the drum 11 also closely related to the roughness of an image. When the linear velocity ratio was increased from 1.2, the magnet brush more frequently contacted the drum 11. This is comparable in effect with reducing the ratio of the total area of voids to the total area of developing zone and improves roughness. However, a linear velocity ratio larger than 3 brings about image defects including the omission of the edges of images. The linear velocity ratio should therefore fall between 1.2 and 3, preferably between 1.7 and 2.3. Even when it is desired to lower reduce the linear velocity ratio for any other reason, images desirable in graininess are achievable if the void condition of the magnet brush is improved. This additionally extends the life of the developer.

The main pole P1, included in the magnetic field forming means and facing the developing zone, is directed toward the upstream side by an angle of 0° and 5° in the direction of rotation of the sleeve 4. When the main pole P1 is so directed slightly toward the positive side, the magnet brush falls down at a position shifted from the position where the angle is 0° toward the position where the gap for development is small. Consequently, the voids of the magnet brush become smaller at the downstream region of the developing zone, further reducing roughness.

In the illustrative embodiment, use is made of carrier grains whose magnetization strength as is between 30 emu/g and 100 emu/g, preferably between 40 emu/g and 80 emu/g, in a magnetic field of 1 kOe. The range of from 40 emu/g to 80 emu/g allows a high quality image substantially free from roughness to be implemented even when a DC bias is used for development. The magnetization strength σs brings about carrier deposition and therefore defective images if smaller than 40 emu/g or makes the magnet brush sparse in the developing zone and therefore gives rise to the previously stated problem if greater than 80 emu/g.

The carrier grains are provided with a dynamic resistance ranging from $10^5$ Ω.cm to $10^{10}$ Ω.cm, so that carrier deposition is obviated while a sufficient developing ability is guaranteed.

Also, the carrier grains are provided with a volume-mean grain size ranging from 20 μm to 60 μm. For a given ratio of the total area of voids to the total area of developing zone, carrier grains with such a small grain size contact the drum 11 more than carrier grains with a large grain size as to the number of grains. It is therefore possible to uniformly deposit toner grains on the drum 11 for thereby realizing images free from roughness.

As stated above, by determining the density of the magnet brush as characteristic values closer to the actual developing operation, the illustrative embodiment insures high quality images free from roughness.

Why the illustrative embodiment pays attention to the size of the individual void, as seen from the drum 11 side, in the axial direction of the sleeve 4 and the direction of rotation of the sleeve 4 will be described more specifically hereinafter. To protect images from irregular density and roughness, a magnet brush should ideally have no directivity. In practice, however, in a magnetic field, brush chains constituting a magnet brush rise with ruggedness based on grain size, saturation magnetization, field strength and so forth when such brush chains rise in the upstream region of the developing zone, the tips of the brush chains are pressed and rubbed by the drum 11 with the result that brush chains increase in number, but decrease in height. Consequently, the magnet brush is denser in the center region of the developing zone than in the upstream region. However, if the magnet brush is not uniform in the upstream region, then the non-uniform condition remains even in the center region and causes numerous voids, which are elongate in the direction of rotation of the sleeve 4, to appear in the magnet brush. The elongate voids prevent the magnet brush from sufficiently contacting the drum 11 despite the rotation of the sleeve 4, rendering the resulting image to appear rough.

For the above reason, to free images from roughness, it is important not only to reduce the size of the individual void in the entire developing zone but also to prevent the individual void from extending in the direction of rotation of the sleeve 4. This is why the size of the individual void is controlled to 70 μm or below on the average in the axial direction of the sleeve 4 and to 200 μm or below on the average in the direction of rotation of the sleeve 4, as stated earlier.

The void state function stated earlier is a characteristic value representative of the condition of the tips of the magnet brush joining in development. The void state function takes account of the influence of the upstream and downstream regions of the developing zone on the center region as well. More specifically, considering that the tips of a magnet brush are uniformly arranged if voids smaller in area than preselected one are predominant over the other voids, the void state function indicates the state of voids in each of the upstream, center and downstream regions. In the illustrative embodiment, the void state function is selected to be larger than 0, but smaller than 5, as stated previously.

In summary, in accordance with the present invention, high quality images free from roughness are achievable on the basis of the density of a magnet brush defined specifically as characteristic values closer to the actual developing operation.

Various modifications will become possible for those skilled in the art after receiving the teachings of the present disclosure without departing from the scope thereof.

What is claimed is:

1. In a method of developing a latent image formed on an image carrier by using a sleeve, which accommodates magnetic field forming means having a plurality of magnetic poles and faces said image carrier, and causing said sleeve to rotate and convey a developer made up of toner grains and magnetic carrier grains and deposited thereon to a developing zone for thereby feeding said toner grains from a magnet brush formed by said developer to said latent image, when said developing zone is seen from an image carrier side, a ratio of a total area of voids present at tips of said magnet brush to a total area of said developing zone is 25% or less.

2. In a method of developing a latent image formed on an image carrier by using a sleeve, which accommodates magnetic field forming means having a plurality of magnetic poles and faces said image carrier, and causing said sleeve to rotate and convey a developer made up of toner grains and magnetic carrier grains and deposited thereon to a developing zone for thereby feeding said toner grains from a magnet brush formed by said developer to said latent image, when said developing zone is divided into an upstream region, a center region and a downstream region and when said center region is seen from an image carrier side, a ratio of a total area of voids present at tips of said magnet brush in said center region to a total area of said center region is 25% or less.

3. In a method of developing a latent image formed on an image carrier by using a sleeve, which accommodates magnetic field forming means having a plurality of magnetic poles and faces said image carrier, and causing said sleeve to rotate and convey a developer made up of toner grains and magnetic carrier grains and deposited thereon to a developing zone for thereby feeding said toner grains from a magnet brush formed by said developer to said latent image, when said developing zone is divided into an upstream region, a center region and a downstream region and when said center region is seen from an image carrier side, a distribution of voids present at tips of said magnet brush in said center region satisfies a relation:

$$S1/S2>0.4$$

where S1 denotes a total area of, among individual voids present in said center region, voids smaller than a mean size, and S2 denotes a total area of voids present in said center region.

4. In a method of developing a latent image formed on an image carrier by using a sleeve, which accommodates magnetic field forming means having a plurality of magnetic poles and faces said image carrier, and causing said sleeve to rotate and convey a developer made up of toner grains and magnetic carrier grains and deposited thereon to a developing zone for thereby feeding said toner grains from a magnet brush formed by said developer to said latent image, when said developing zone is divided into an upstream region, a center region and a downstream region and when said upstream region, said center region and said downstream region are seen from an image carrier side, a mean area of individual voids present at tips of said magnet brush is 7,500 $\mu m^2$ or below, 5,000 $\mu m^2$ or below and 7,500 $\mu m^2$ or below, respectively.

5. In a method of developing a latent image formed on an image carrier by using a sleeve, which accommodates magnetic field forming means having a plurality of magnetic poles and faces said image carrier, and causing said sleeve to rotate and convey a developer made up of toner grains and magnetic carrier grains and deposited thereon to a developing zone for thereby feeding said toner grains from a magnet brush formed by said developer to said latent image, when said developing zone is divided into an upstream region, a center region and a downstream region and when said center region is seen from an image carrier side, a mean size of individual voids present at tips of said magnet brush in said center portion is 7 $\mu m$ or below in an axial direction of said sleeve and 200 $\mu m$ or below in a direction of rotation of said sleeve.

6. In a method of developing a latent image formed on an image carrier by using a sleeve, which accommodates magnetic field forming means having a plurality of magnetic poles and faces said image carrier, and causing said sleeve to rotate and convey a developer made up of toner grains and magnetic carrier grains and deposited thereon to a developing zone for thereby feeding said toner grains from a magnet brush formed by said developer to said latent image, when said developing zone is divided into an upstream region, a center region and a downstream region and when said upstream region, said center region and said downstream region are seen from an image carrier side, there holds following relations at tips of said magnet brush:

$$0<\alpha 1.p1.q1+\alpha 2.p2.q2+\alpha 3.p3.q3<5\alpha 1+\alpha 2+\alpha 3=1$$

where p1 denotes a ratio of a total area of voids present in said upstream region to a total area of said upstream region, p2 denotes a ratio of a total area of voids present in said center region to a total area of said center region, p1 denotes a ratio of a total area of voids present in said downstream region to a total area of said downstream region, q1 denotes a ratio of voids present in said upstream region and having an area of 17,500 $\mu m^2$ or above to the total area of the voids present in said upstream region, q2 denotes a ratio of voids present in said center region and having an area of 4,000 $\mu m^2$ or above to the total area of the voids present in said center region, q3 denotes a ratio of voids present in said downstream region and having an area of 17,500 $\mu m^2$ or above to the total area of the voids present in said downstream region, $\alpha$1 denotes a weighting coefficient, which is a constant of 0.375, assigned to said upstream region, $\alpha$2 denotes a weighting coefficient, which is a constant of 0.25, assigned to said center region, and $\alpha$3 denotes a weighting coefficient, which is a constant, assigned to said downstream region.

7. A developing device for developing a latent image formed on an image carrier with a developer made up of toner grains and magnetic carrier grains, said developing device comprising:

a rotatable sleeve facing the image carrier; and magnetic field forming means having a plurality of magnetic poles and held stationary inside said sleeve;

said sleeve being rotated to convey the developer deposited thereon to a developing zone for thereby feeding the toner grains from a magnet brush formed by said developer to the latent image;

wherein when the developing zone is seen from an image carrier side, a ratio of a total area of voids present at tips of the magnet brush to a total area of said developing zone is 25% or less.

8. The device as claimed in claim 7, wherein a main magnetic pole of said magnetic field forming means facing the developing zone has a flux density of 60 mT to 120 mT in a normal direction.

9. The device as claimed in claim 7, wherein a bias for development applied to said sleeve comprises an oscillating current that forms an alternating electric field between said sleeve and the image carrier.

10. The device as claimed in claim 7, wherein the developer is deposited on said sleeve in an amount of between 20 $mg/cm^2$ and 100 $mg/cm^2$.

11. The device as claimed in claim 7, wherein a linear velocity ratio of said sleeve to the image carrier is between 1.3 and 3.

12. The device as claimed in claim 7, wherein a main magnetic pole of said magnetic field forming means facing the developing zone is directed toward an upstream side by an angle of 0° to 5°.

13. The device as claimed in claim 7, wherein magnetic strength of the carrier grains for as unit mass is between 30 emu/g and 100 emu/g in a magnetic field of 1 kOe.

14. The device as claimed in claim 7, wherein a dynamic resistance of the carrier grains is between $10^5$ Ω·cm and $10^{10}$ Ω·cm.

15. The device as claimed in claim 7, wherein a volume-mean grain size of the carrier grains is between 20 μm and 60 μm.

16. A developing device for developing a latent image formed on an image carrier with a developer made up of toner grains and magnetic carrier grains, said developing device comprising:

a rotatable sleeve facing the image carrier; and magnetic field forming means having a plurality of magnetic poles and held stationary inside said sleeve;

said sleeve being rotated to convey the developer deposited thereon to a developing zone for thereby feeding the toner grains from a magnet brush formed by said developer to the latent image;

wherein when the developing zone is divided into an upstream region, a center region and a downstream region and when said center region is seen from an image carrier side, a ratio of a total area of voids present at tips of the magnet brush in said center region to a total area of said center region is 25% or less.

17. The device as claimed in claim 16, wherein a main magnetic pole of said magnetic field forming means facing the developing zone has a flux density of 60 mT to 120 mT in a normal direction.

18. The device as claimed in claim 16, wherein a bias for development applied to said sleeve comprises an oscillating current that forms an alternating electric field between said sleeve and the image carrier.

19. The device as claimed in claim 16, wherein the developer is deposited on said sleeve in an amount of between 20 $mg/cm^2$ and 100 $mg/cm^2$.

20. The device as claimed in claim 16, wherein a linear velocity ratio of said sleeve to the image carrier is between 1.3 and 3.

21. The device as claimed in claim 16, wherein a main magnetic pole of said magnetic field forming means facing the developing zone is directed toward an upstream side by an angle of 0° to 5°.

22. The device as claimed in claim 16, wherein magnetic strength of the carrier grains for as unit mass is between 30 emu/g and 100 emu/g in a magnetic field of 1 kOe.

23. The device as claimed in claim 16, wherein a dynamic resistance of the carrier grains is between $10^5$ Ω·cm and $10^{10}$ Ω·cm.

24. The device as claimed in claim 16, wherein a volume-mean grain size of the carrier grains is between 20 μm and 60 μm.

25. A developing device for developing a latent image formed on an image carrier with a developer made up of toner grains and magnetic carrier grains, said developing device comprising:

a rotatable sleeve facing the image carrier; and magnetic field forming means having a plurality of magnetic poles and held stationary inside said sleeve;

said sleeve being rotated to convey the developer deposited thereon to a developing zone for thereby feeding the toner grains from a magnet brush formed by said developer to the latent image;

wherein when the developing zone is divided into an upstream region, a center region and a downstream region and when said center region is seen from an image carrier side, a distribution of voids present at tips of the magnet brush in said center region satisfies a relation:

$$S1/S2>0.4$$

where S1 denotes a total area of, among individual voids present in said center region, voids smaller in size than a mean size, and S2 denotes a total area of voids present in said center region.

26. The device as claimed in claim 25, wherein a main magnetic pole of said magnetic field forming means facing the developing zone has a flux density of 60 mT to 120 mT in a normal direction.

27. The device as claimed in claim 25, wherein a bias for development applied to said sleeve comprises an oscillating current that forms an alternating electric field between said sleeve and the image carrier.

28. The device as claimed in claim 25, wherein the developer is deposited on said sleeve in an amount of between 20 $mg/cm^2$ and 100 $mg/cm^2$.

29. The device as claimed in claim 25, wherein a linear velocity ratio of said sleeve to the image carrier is between 1.3 and 3.

30. The device as claimed in claim 25, wherein a main magnetic pole of said magnetic field forming means facing the developing zone is directed toward an upstream side by an angle of 0° to 5°.

31. The device as claimed in claim 25, wherein magnetic strength of the carrier grains for as unit mass is between 30 emu/g and 100 emu/g in a magnetic field of 1 kOe.

32. The device as claimed in claim 25, wherein a dynamic resistance of the carrier grains is between $10^5$ Ω·cm and $10^{10}$ Ω·cm.

33. The device as claimed in claim 25, wherein a volume-mean grain size of the carrier grains is between 20 μm and 60 μm.

34. A developing device for developing a latent image formed on an image carrier with a developer made up of toner grains and magnetic carrier grains, said developing device comprising:

a rotatable sleeve facing the image carrier; and magnetic field forming means having a plurality of magnetic poles and held stationary inside said sleeve;

said sleeve being rotated to convey the developer deposited thereon to a developing zone for thereby feeding the toner grains from a magnet brush formed by said developer to the latent image;

wherein when the developing zone is divided into an upstream region, a center region and a downstream region and when said upstream region, said center region and said downstream region are seen from an image carrier side, a mean area of individual voids present at tips of the magnet brush is 7,500 $\mu m^2$ or below, 5,000 $\mu m^2$ or below and 7,500 $\mu m^2$ or below, respectively.

35. The device as claimed in claim 34, wherein a main magnetic pole of said magnetic field forming means facing the developing zone has a flux density of 60 mT to 120 mT in a normal direction.

36. The device as claimed in claim 34, wherein a bias for development applied to said sleeve comprises an oscillating current that forms an alternating electric field between said sleeve and the image carrier.

37. The device as claimed in claim 34, wherein the developer is deposited on said sleeve in an amount of between 20 mg/cm$^2$ and 100 mg/cm$^2$.

38. The device as claimed in claim 34, wherein a linear velocity ratio of said sleeve to the image carrier is between 1.3 and 3.

39. The device as claimed in claim 34, wherein a main magnetic pole of said magnetic field forming means facing the developing zone is directed toward an upstream side by an angle of 0° to 5°.

40. The device as claimed in claim 34, wherein magnetic strength of the carrier grains for as unit mass is between 30 emu/g and 100 emu/g in a magnetic field of 1 kOe.

41. The device as claimed in claim 34, wherein a dynamic resistance of the carrier grains is between $10^5$ Ω·cm and $10^{10}$ Ω·cm.

42. The device as claimed in claim 34, wherein a volume-mean grain size of the carrier grains is between 20 $\mu$m and 60 $\mu$m.

43. A developing device for developing a latent image formed on an image carrier with a developer made up of toner grains and magnetic carrier grains, said developing device comprising:

a rotatable sleeve facing the image carrier; and magnetic field forming means having a plurality of magnetic poles and held stationary inside said sleeve;

said sleeve being rotated to convey the developer deposited thereon to a developing zone for thereby feeding the toner grains from a magnet brush formed by said developer to the latent image;

wherein when the developing zone is divided into an upstream region, a center region and a downstream region and when said center region is seen from an image carrier side, a mean size of individual voids present at tips of the magnet brush in said center portion is 7 $\mu$m or below in an axial direction of said sleeve and 200 $\mu$m or below in a direction of rotation of said sleeve.

44. The device as claimed in claim 43, wherein a main magnetic pole of said magnetic field forming means facing the developing zone has a flux density of 60 mT to 120 mT in a normal direction.

45. The device as claimed in claim 43, wherein a bias for development applied to said sleeve comprises an oscillating current that forms an alternating electric field between said sleeve and the image carrier.

46. The device as claimed in claim 43, wherein the developer is deposited on said sleeve in an amount of between 20 mg/cm$^2$ and 100 mg/cm$^2$.

47. The device as claimed in claim 43, wherein a linear velocity ratio of said sleeve to the image carrier is between 1.3 and 3.

48. The device as claimed in claim 43, wherein a main magnetic pole of said magnetic field forming means facing the developing zone is directed toward an upstream side by an angle of 0° to 5°.

49. The device as claimed in claim 43, wherein magnetic strength of the carrier grains for as unit mass is between 30 emu/g and 100 emu/g in a magnetic field of 1 kOe.

50. The device as claimed in claim 43, wherein a dynamic resistance of the carrier grains is between $10^5$ Ω·cm and $10^{10}$ Ω·cm.

51. The device as claimed in claim 43, wherein a volume-mean grain size of the carrier grains is between 20 $\mu$m and 60 $\mu$m.

52. A developing device for developing a latent image formed on an image carrier with a developer made up of toner grains and magnetic carrier grains, said developing device comprising:

a rotatable sleeve facing the image carrier; and magnetic field forming means having a plurality of magnetic poles and held stationary inside said sleeve;

said sleeve being rotated to convey the developer deposited thereon to a developing zone for thereby feeding the toner grains from a magnet brush formed by said developer to the latent image;

wherein when the developing zone is divided into an upstream region, a center region and a downstream region and when said upstream region, said center region and said downstream region are seen from an image carrier side, there holds following relations at tips of the magnet brush:

$$0<\alpha 1.p1.q1+\alpha 2.p2.q2+\alpha 3.p3.q3<5\alpha 1+\alpha 2+\alpha 3=1$$

where p1 denotes a ratio of a total area of voids present in said upstream region to a total area of said upstream region, p2 denotes a ratio of a total area of voids present in said center region to a total area of said center region, p1 denotes a ratio of a total area of voids present in said downstream region to a total area of said downstream region, q1 denotes a ratio of voids present in said upstream region and having an area of 17,500 $\mu m^2$ or above to the total area of the voids present in said upstream region, q2 denotes a ratio of voids present in said center region and having an area of 4,000 $\mu m^2$ or above to the total area of the voids present in said center region, q3 denotes a ratio of voids present in said downstream region and having an area of 17,500 $\mu m^2$ or above to the total area of the voids present in said downstream region, $\alpha$1 denotes a weighting coefficient, which is a constant of 0.375, assigned to said upstream region, $\alpha$2 denotes a weighting coefficient, which is a constant of 0.25, assigned to said center region, and $\alpha$3 denotes a weighting coefficient, which is a constant, assigned to said downstream region.

53. The device as claimed in claim 52, wherein a main magnetic pole of said magnetic field forming means facing the developing zone has a flux density of 60 mT to 120 mT in a normal direction.

54. The device as claimed in claim 52, wherein a bias for development applied to said sleeve comprises an oscillating current that forms an alternating electric field between said sleeve and the image carrier.

55. The device as claimed in claim 52, wherein the developer is deposited on said sleeve in an amount of between 20 mg/cm$^2$ and 100 mg/cm$^2$.

56. The device as claimed in claim 52, wherein a linear velocity ratio of said sleeve to the image carrier is between 1.3 and 3.

57. The device as claimed in claim 52, wherein a main magnetic pole of said magnetic field forming means facing the developing zone is directed toward an upstream side by an angle of 0° to 5°.

58. The device as claimed in claim 52, wherein magnetic strength of the carrier grains for as unit mass is between 30 emu/g and 100 emu/g in a magnetic field of 1 kOe.

59. The device as claimed in claim 52, wherein a dynamic resistance of the carrier grains is between $10^5$ Ω·cm and $10^{10}$ Ω·cm.

60. The device as claimed in claim 52, wherein a volume-mean grain size of the carrier grains is between 20 μm and 60 μm.

61. An image forming apparatus comprising:

an image carrier configured to carry a latent image thereon; and a developing device configured to develop the latent image with a developer made up of toner grains and magnetic carrier grains;

said developing device comprising:

a rotatable sleeve facing said image carrier; and magnetic field forming means having a plurality of magnetic poles and held stationary inside said sleeve;

said sleeve being rotated to convey the developer deposited thereon to a developing zone for thereby feeding the toner grains from a magnet brush formed by said developer to the latent image;

wherein when the developing zone is seen from an image carrier side, a ratio of a total area of voids present at tips of the magnet brush to a total area of said developing zone is 25% or less.

62. An image forming apparatus comprising:

an image carrier configured to carry a latent image thereon; and a developing device configured to develop the latent image with a developer made up of toner grains and magnetic carrier grains;

said developing device comprising:

a rotatable sleeve facing said image carrier; and magnetic field forming means having a plurality of magnetic poles and held stationary inside said sleeve;

said sleeve being rotated to convey the developer deposited thereon to a developing zone for thereby feeding the toner grains from a magnet brush formed by said developer to the latent image;

wherein when the developing zone is divided into an upstream region, a center region and a downstream region and when said center region is seen from an image carrier side, a ratio of a total area of voids present at tips of the magnet brush in said center region to a total area of said center region is 25% or less.

63. An image forming apparatus comprising:

an image carrier configured to carry a latent image thereon; and a developing device configured to develop the latent image with a developer made up of toner grains and magnetic carrier grains;

said developing device comprising:

a rotatable sleeve facing said image carrier; and magnetic field forming means having a plurality of magnetic poles and held stationary inside said sleeve;

said sleeve being rotated to convey the developer deposited thereon to a developing zone for thereby feeding the toner grains from a magnet brush formed by said developer to the latent image;

wherein when the developing zone is divided into an upstream region, a center region and a downstream region and when said center region is seen from an image carrier side, a distribution of voids present at tips of the magnet brush in said center region satisfies a relation:

$$S1/S2>0.4$$

where S1 denotes a total area of, among individual voids present in said center region, voids smaller in size than a mean size, and S2 denotes a total area of voids present in said center region.

64. An image forming apparatus comprising:

an image carrier configured to carry a latent image thereon; and a developing device configured to develop the latent image with a developer made up of toner grains and magnetic carrier grains;

said developing device comprising:

a rotatable sleeve facing said image carrier; and magnetic field forming means having a plurality of magnetic poles and held stationary inside said sleeve;

said sleeve being rotated to convey the developer deposited thereon to a developing zone for thereby feeding the toner grains from a magnet brush formed by said developer to the latent image;

wherein when the developing zone is divided into an upstream region, a center region and a downstream region and when said upstream region, said center region and said downstream region are seen from an image carrier side, a mean area of individual voids present at tips of the magnet brush is 7,500 μm$^2$ or below, 5,000 μm$^2$ or below and 7,500 μm$^2$ or below, respectively.

65. An image forming apparatus comprising:

an image carrier configured to carry a latent image thereon; and a developing device configured to develop the latent image with a developer made up of toner grains and magnetic carrier grains;

said developing device comprising:

a rotatable sleeve facing said image carrier; and magnetic field forming means having a plurality of magnetic poles and held stationary inside said sleeve;

said sleeve being rotated to convey the developer deposited thereon to a developing zone for thereby feeding the toner grains from a magnet brush formed by said developer to the latent image;

wherein when the developing zone is divided into an upstream region, a center region and a downstream region and when said center region is seen from an image carrier side, a mean size of individual voids present at tips of the magnet brush in said center portion is 7 μm or below in an axial direction of said sleeve and 200 μm or below in a direction of rotation of said sleeve.

66. An image forming apparatus comprising:

an image carrier configured to carry a latent image thereon; and a developing device configured to develop the latent image with a developer made up of toner grains and magnetic carrier grains;

said developing device comprising:

a rotatable sleeve facing said image carrier; and magnetic field forming means having a plurality of magnetic poles and held stationary inside said sleeve;

said sleeve being rotated to convey the developer deposited thereon to a developing zone for thereby feeding the toner grains from a magnet brush formed by said developer to the latent image;

wherein when the developing zone is divided into an upstream region, a center region and a downstream region and when said upstream region, said center region and said downstream region are seen from an image carrier side, there holds following relations at tips of the magnet brush:

$$0<\alpha 1.p1.q1+\alpha 2.p2.q2+\alpha 3.p3.q3<5\alpha 1+\alpha 2+\alpha 3=1$$

where p1 denotes a ratio of a total area of voids present in said upstream region to a total area of said upstream region, p2 denotes a ratio of a total area of voids present in said center region to a total area of said center region, p1 denotes a ratio of a total area of voids present in said downstream region to a total area of said downstream region, q1 denotes a ratio of voids present in said upstream region and having an area of 17,500 $\mu m^2$ or above to the total area of the voids present in said upstream region, q2 denotes a ratio of voids present in said center region and having an area of 4,000 $\mu m^2$ or above to the total area of the voids present in said center region, q3 denotes a ratio of voids present in said downstream region and having an area of 17,500 $\mu m^2$ or above to the total area of the voids present in said downstream region, $\alpha$1 denotes a weighting coefficient, which is a constant of 0.375, assigned to said upstream region, $\alpha$2 denotes a weighting coefficient, which is a constant of 0.25, assigned to said center region, and $\alpha$3 denotes a weighting coefficient, which is a constant, assigned to said downstream region.

* * * * *